United States Patent [19]

Place

[11] 4,243,858

[45] Jan. 6, 1981

[54] SNAP DISC OPERATED PRESSURE SWITCH

[75] Inventor: Donald E. Place, Mansfield, Ohio

[73] Assignee: Therm-O-Disc Incorporated, Mansfield, Ohio

[21] Appl. No.: 4,743

[22] Filed: Jan. 19, 1979

Related U.S. Application Data

[63] Continuation-in-part of Ser. No. 905,887, May 15, 1978, abandoned.

[51] Int. Cl.[3] ..... H01H 35/34

[52] U.S. Cl. ..... 200/83 P; 200/83 W; 200/67 DB; 200/283

[58] Field of Search ..... 200/83 W, 83 Y, 83 P, 200/83 R, 61.25, 81 R, 67 R, 67 D, 67 DA, 67 DB, 83 S, 244, 250, 283, 286, 290

[56] References Cited

U.S. PATENT DOCUMENTS

| | | | |
|---|---|---|---|
| 3,032,626 | 5/1962 | Payne | 200/83 P |
| 3,302,269 | 2/1967 | Cooper | 200/83 R |
| 3,553,402 | 1/1971 | Hire | 200/83 P |
| 3,773,991 | 11/1973 | Krieger | 200/83 S |
| 3,816,685 | 6/1974 | Fiore | 200/83 P |
| 4,121,074 | 10/1978 | Orcutt | 200/83 P |
| 4,145,588 | 3/1979 | Orcutt | 200/83 P |

*Primary Examiner*—Gerald P. Tolin

*Attorney, Agent, or Firm*—Pearne, Gordon, Sessions, McCoy & Granger

[57] ABSTRACT

A snap disc operator pressure switch is disclosed in which a thin flexible diaphragm is positioned adjacent to the disc to isolate the pressure chamber from the disc chamber and to transmit the pressure forces directly to the surface of the disc. The disc is positioned in a disc seat and is held therein by the diaphragm. The calibration of the disc is not adversely affected because it is not necessary to provide a seal directly with the disc. The disc seat member is shaped to support the disc against overpressure and to provide a guide for the switch bumper. When higher operating pressures are required, two discs are positioned in the disc seat at face-to-face adjacency and the device operates at a pressure substantially equal to the sum of the calibration pressures of the discs. In another embodiment, the movable arm of the switch is biased closed and is moved to an open position by a spring-biased operator. In such embodiment, the maximum stress applied to the movable arm is determined by the spring force on the operator, so overstressing and fatigue failures of the arm are substantially eliminated.

10 Claims, 7 Drawing Figures

SNAP DISC OPERATED PRESSURE SWITCH

This is a continuation-in-part of the copending application, Ser. No. 905,887, filed May 15, 1978, now abandoned.

BACKGROUND OF INVENTION

This invention relates generally to pressure switches, and more particularly to a novel, improved pressure switch of simplified structure in which a switch is operated by a shallow, dish shaped disc movable with snap action between two positions of stability in response to predetermined pressures.

PRIOR ART

Snap disc-operated pressure-responsive switching devices are known. An example of such device is illustrated and described in U.S. Pat. Nos. 3,302,269, 3,365,557, 3,584,168, and 4,091,249. In such devices, the snap disc itself usually defines a portion of a pressure chamber so that fluid under pressure acts directly on the disc to cause it to snap back and forth on reaching predetermined pressure conditions. In such devices, it is necessary to estabish a fluid seal between the housing and the disc to prevent leakage. If the seal is produced by gripping the disc at its periphery, the structure of the seal produces forces on the disc which tend to alter the operating pressure of the disc. On the other hand, if the seal between the disc and the housing is provided by a weld or the like, as illustrated in some of the patents cited above, stresses tend to occur which, again, alter the operating temperature of the disc. Consequently, in devices of the prior art such as the device illustrated in such patents, it is generally necessary to provide calibration means to pull in the disc or otherwise be certain that the disc will operate at the desired operating pressures. Further, the cost of accurately producing a weld to establish a seal between the housing and disc is relatively high.

In other instances, a diaphragm is used in conjunction with a snap disc wherein an actuator is positioned between the diaphragm and the disc to transmit the pressure forces to the disc. In such devices, the calibration pressures of the disc are altered by the actuator.

SUMMARY OF THE INVENTION

In accordance with the present invention, a novel and improved snap disc-operated pressure switch is provided having a simplified structure which provides operating accuracy and low manufacturing cost.

In accordance with one important aspect of this invention, a nonmetallic, flexible diaphragm is positioned within a housing immediately against a shallow dish-shaped snap disc to seal the pressure chamber of the device while providing a force-transmitting medium which efficiently transmits the pressure force directly to the disc without exposing the disc directly to the pressure fluid. With such structure, it is not necessary to produce a seal between the disc per se and the housing even though the fluid under pressure within the pressure chamber effectively acts directly upon the disc. The elimination of the requirement for a direct fluid seal between the disc and the housing improves operating accuracy by eliminating the application of stress or forces to the disc other than the forces resulting from the fluid under pressure. Consequently, the calibration of the disc established during its manufacture is not altered by its installation within the device.

In accordance with another important aspect of this invention, the disc seat member is provided with a disc-supporting wall extending inwardly from the seat which supports the disc against overstressing when high pressures are encountered. Such element also provides a guide for the bumper which extends between the disc and the switch.

In accordance with another important aspect of this invention, a novel and improved switch system is provided to limit the stresses applied to the movable contact support arm and to eliminate fatigue failues when the switch is operated through a large number of cycles.

In the illustrated embodiments, the diaphragm is formed of a thin thermoplastic material, such as polyimide, marketed under the trade name "Kapton." A peripheral seal is established between the diaphragm and the housing assembly by a simple resilient gasket which may be formed, for example, of neoprene or nitrile. Preferably, a unitary element which provides the disc seat also protects the disc from damage due to overpressure, provides the switch bumper guide, and is formed with an annular rib engaging the diaphragm to ensure that localized high pressure is established between the diaphragm and the neoprene seal member to prevent the possibility of leakage.

The housing assembly, including the switch housing and the pressure chamber housing, is permanently connected by the simple expediency of crimping the pressure chamber housing to the switch housing. Preferably, the structure is arranged so that devices requiring relatively high operating accuracy can be assembled and held together without crimping to allow testing of the assembly to ensure that it meets specification requirements before the assembly is completed by the crimping operation. In the event that a given disc does not operate within the specification requirements for the device, it is then an easy matter to disassemble the device and replace the disc with another disc to provide the required operating accuracy.

In the embodiment arranged to limit stress on the movable contact support arm, the arm is biased to a normally closed position. A spring-biased operator is slidably mounted in the body and provides a central projection which extends through an opening in the contact arm. Such projection engages the end of the bumper and a shoulder on the operator around such projection is engaged by the arm on the side thereof remote from the bumper. With this structure, the maximum stress applied to the movable contact support arm occurs when the contacts are open while the arm is functioning in a cantilever manner and the arm is not overstressed under high pressure on the disc. In fact, once the contacts close, overtravel of the disc merely causes separation of the contact arm and the operator shoulder. Consequently, contact arm fatigue failures are virtually eliminated.

In accordance with another aspect of this invention, two discs can be mounted in abutting relationship within the device to allow operation at higher pressures.

DETAILED DESCRIPTION OF THE DRAWINGS

Figure 1:
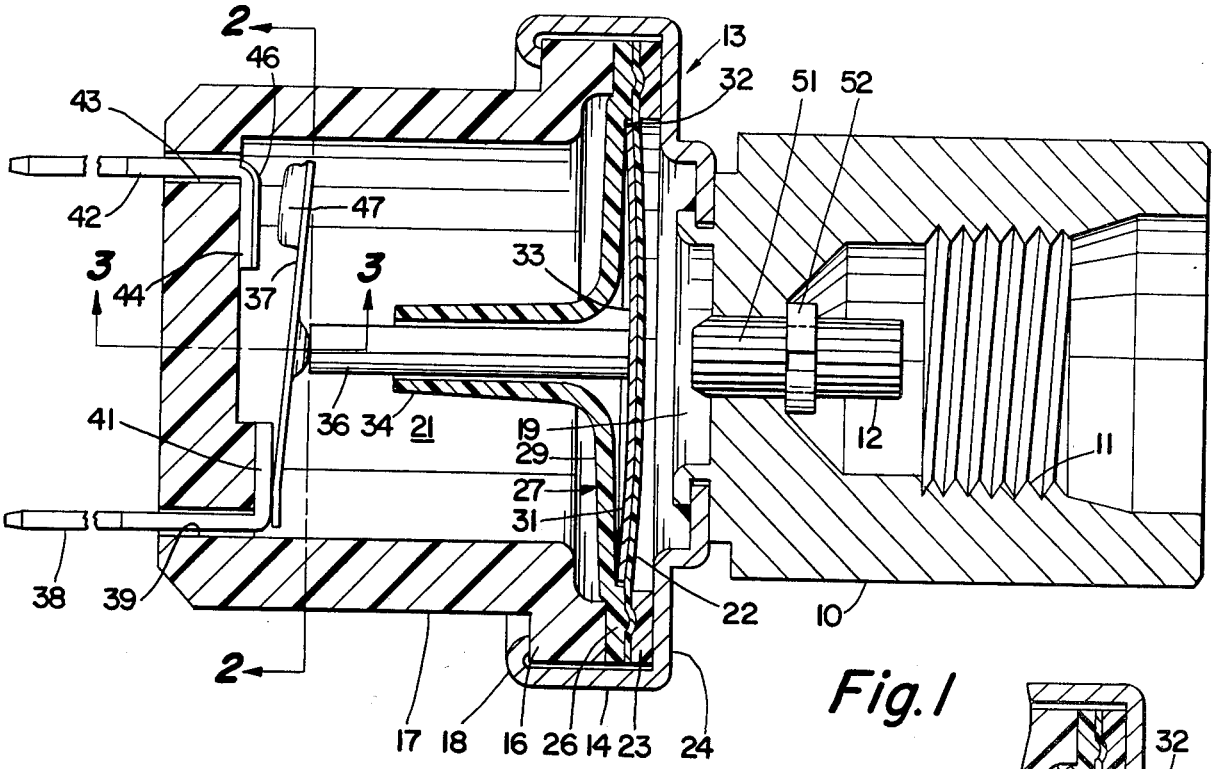
FIG. 1 is a side elevation in longitudinal section, illustrating the general structural arrangement of one preferred embodiment of this invention.

The one illustrated pressure switch, in accordance with the present invention (illustrated in FIGS. 1 to 5), is particularly suited for use in automotive air conditioning systems wherein it is threaded onto a Schraeder-type valve. The housing assembly includes a threaded fitting portion 10 providing internal threads 11 which thread onto the Schraeder valve when the device is installed. During installation, a valve operator 12 engages the valve stem of the Schraeder valve and opens the valve so that fluid communication is provided with the associated system. When the device is removed for replacement or the like, the Schraeder valve automatically closes to seal the system.

Welded to the fitting portion 10 is a sheet metal housing 13 having an axially extending wall 14 which fits around a flange 16 and a switch housing member 17 and is crimped at 18 to permanently connect the housing members together. As an alternative, the fitting portion 10 and housing 13 can be formed as a unitary element, for example, as a screw machine part.

The housing 13 and switch housing 17 cooperate to define a cavity divided into a pressure chamber 19 and a switch chamber 21 by a flexible diaphragm 22 formed of a nonmetallic material such as a polyimide marketed under the trade name "Kapton" by E. I. DuPont de Nemours & Company. A peripheral seal is provided between the diaphragm 22 and the housing 13 by a gasket 23, preferably formed of neoprene or nitrile or the like, which is compressed between a radial flange 24 on the housing and one surface of the diaphragm by a flange 26 of a disc seat member 27. The flange 26 of the disc member 27 is held against the side of the diaphragm 22 opposite the gasket 23 by the flange 16, which is held by the crimping of the housing 13. Preferably, the flange 26 is formed with an annular rib, which produces an annular zone of high compression to ensure that leakage does not occur between the diaphragm and the gasket.

The disc seat member is provided with a radially inward extending wall 29 having a forward face 31 spaced back from the forward face of the flange 26 to provide a disc seat 32 in which a shallow dished shape snap disc 33 is positioned. The snap disc 33 is shaped to provide two positions of stability between which it moves with snap action in response to predetermined pressures in the pressure chamber 19.

In the position illustrated in FIG. 1, the disc is arched toward the chamber 19 and is seated at its periphery in the disc seat 32. The diaphragm engages the disc and transmits fluid forces from the chamber 19 to the disc so that when sufficient pressure is developed in the chamber 19, the disc is caused to snap through to its opposite position of stability, in which it extends substantially along the forward face 31 of the disc seat member 27. In order to ensure that the forward face 31 does not interfere with such snap movement to the opposite position of stability, it is inclined back from the plane of the disc seat to allow the snap disc 33 to snap through to its opposite position of stability. However, such face 31 is positioned against or adjacent to the disc after it snaps through to support the disc and prevent it from being damaged if overpressure occurs in the pressure chamber 19.

Because the forward face 31 is inclined back from the plane of the edge of the disc 33 the disc is supported only at its edge in both positions of stability. This insures that the effective area of the disc does not change when it snaps back and forth. If for example the disc seat were flat the disc would be supported on its edge in one position and would be supported on the inner edge of the seat in its other position. In such structure, the effective area of the disc against which the pressure would react would not be the same in both positions. However, an inclined seat, having an angle of inclination greater than the disc curvature at its edge, eliminates such effective area change because the disc is supported at its edge in both positions.

The disc seat member 27 is also provided with a central tubular portion 34 to guide a cylindrical bumper 36, which extends between the disc 33 and a movable contact arm 37 for the operation of the switch.

The switch includes a first terminal 38 which extends through an opening 39 in the switch housing 17 and provides a lateral portion 41 on which one end of the movable contact arm 37 is mounted. A stationary contact is provided by a second terminal member 42, which extends through an opening 43 in the housing 17 and is also provided with a lateral portion 44 providing a layer of contact material 46 which functions as the stationary contact. A movable contact 47 is mounted on the free end of the arm 37 and is moved into and out of engagement with the fixed contact 46 by the bumper 36 when the snap disc 33 snaps between its two positions of stability.

Figure 3:
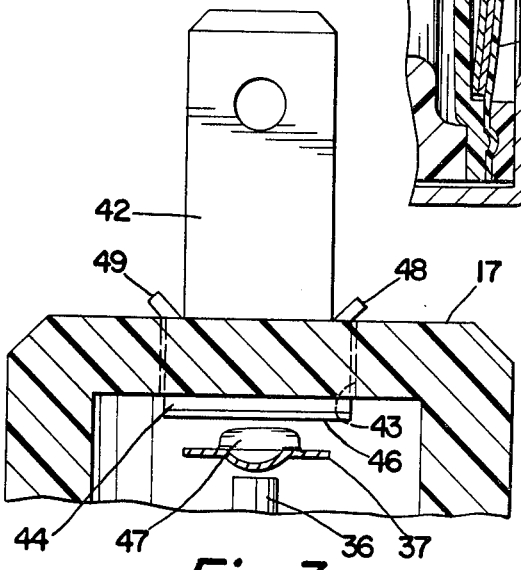
FIG. 3 is a fragmentary section of the switch end of the device, illustrating a simple structure for mounting the terminals of the switch in the switch housing.

FIG. 3 illustrates the manner in which the two terminals 38 and 42 are permanently mounted in the switch housing. After the terminals are positioned in their respective openings, they are staked, as illustrated at 48 and 49, so that they are permanently mounted in position. Preferably, the switch housing 17, the disc seat member 27 and the bumper 36 are molded from a nonconductive plastic material so that separate insulating structure is not required.

Figure 4:
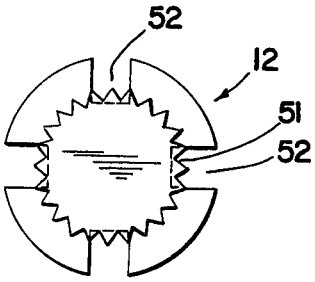
FIG. 4 is a fragmentary end view of a valve operator which is arranged to open a Schraeder valve or the like when the device is installed in an operating system such as an automotive air conditioning system.

The valve operator 12 may also be molded of plastic material and, as best illustrated in FIGS. 1 and 4, is formed with axial grooves 51 and 52 which provide communication between the threaded passage in the fitting portion 10 and the pressure chamber 19. The grooves 51 provide saw tooth shaped ridges to allow it to be press-fitted into position.

Figure 2:
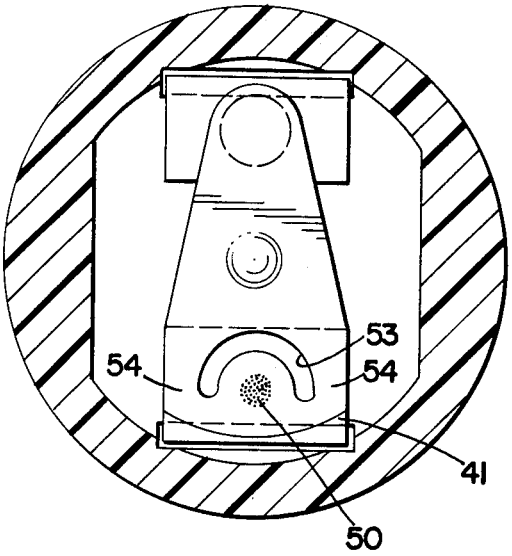
FIG. 2 is a cross section taken along 2—2 of FIG. 1, illustrating the mounting of the arm of the switch.

As best illustrated in FIG. 2, the movable contact arm is mounted on the lateral portion 41 of the terminal 38 by a spot weld at 50, and is formed with a semicircular cutout 53 so as to provide a bend line substantially at 54. With such structure, the welding operation does not significantly affect the spring force of the movable contact arm, and the arm bends along a bend line substantially adjacent to the side of the switch chamber so that the effective length of the arm in its movement is maximized.

The snap disc 33 is shaped during its manufacture so that it operates at substantially the desired pressures of the device. Since the disc is not subjected to any clamping or welding stresses when installed, it acts substantially as a free disc and operates at the calibration pressures determined during its manufacture. The engagement of the face of the disc by the diaphragm 22 does not apply any significant forces to the disc, other than the pressure-induced forces. Consequently, the calibration pressures of the free disc are substantially unaltered by the diaphragm during the assembly of the disc in the device. Further, the diaphragm engages the periphery of the disc and maintains the disc in its seat.

In the illustrated device, the disc may, for example, be calibrated during its manufacture to snap from the illustrated position of stability through to its opposite position of stability whenever the pressure within the pressure chamber 19 reaches 45 psi. During its snap movement from the illustrated position to its opposite position of stability, the bumper 36 moves to the left, as viewed in FIG. 1, and causes the movable contact arm 37 to carry the movable contact into engagement with the fixed contact 46 closing the switch. The disc then remains in such position until the pressure in the chamber 19 drops below the lower calibration pressure, which for example may be 24 psi. Upon reaching the lower operating pressure, the disc snaps back through to the illustrated position, allowing the switch to open.

In accordance with the present invention, the disc calibration pressures are not materially altered by the mounting of the disc, and it is only necessary to manufacture the disc so that when the spring force of the movable arm is applied to the disc in the assembled device, the actual operating pressures of the disc are within the specification requirements of the device.

In the illustrated device, the spring force applied to the disc by the bumper 36 tends to bias the disc toward the illustrated position. Consequently, the disc is manufactured in the above example where it operates at 45 psi and 24 psi, so that in its free, unbiased state, the disc would snap through at a pressure slightly greater than 45 psi in one direction and at a pressure slightly greater than 24 psi in the opposite direction. The amount of change of the calibration pressure caused by the spring bias of the movable contact arm is substantially known and does not vary significantly from one device to the next, so compensation for such force can be uniformly accomplished during the manufacture of the device. On the other hand, in prior art systems where the clamping forces on the disc or stresses produced during welding affect the operating temperature of the disc, it is difficult to provide a uniform variation of the calibration pressures.

With the illustrated structure, the diaphragm fits against the entire disc and is sufficiently elastic and flexible to move with the disc without inducing forces other than pressure forces. Although a Kapton diaphragm is illustrated, other suitable materials such as rubber may be used. If a rubber diaphragm is used, the separate gasket may not be required. The diaphragm, in addition, functions to keep the disc from bouncing when it operates so the tendency for calibration drift to occur during the use of the device is substantially eliminated.

Further, in the present structure in which the disc is freely positioned and is not permanently mounted by welds or the like, it is possible to assemble the entire unit and clamp the housing together without crimping while the unit is tested for operating accuracy. If the unit does not operate under such conditions within the proper pressure ranges, the unit can be disassembled and the disc removed for replacement by another disc for retesting. Once the testing is satisfactorily accomplished, the housing 13 can then be crimped to complete the device. This testing before final assembly can be accomplished with the present invention, since the degree of clamping of the diaphragm does not in any way affect the operating pressure of the disc. Any difference in clamping is taken up solely in the gasket 23. In units in which a higher degree of clamping is provided the gasket is compressed to a greater degree but the relative positions of the switch, disc and diaphragm are not altered. Therefore, the degree of clamping has no effect on the operation of the device.

Figure 5:
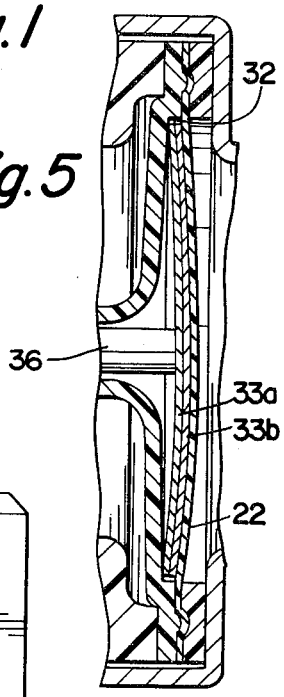
FIG. 5 is a fragmentary, longitudinal section of a second embodiment in which two discs are provided to allow efficient operation at higher pressures.

FIG. 5 illustrates the second embodiment of this invention, which is preferably used when the device must operate at higher pressures. The pressure at which a snap disc operates depends upon the properties and thickness of the material, and depends also on the amount of curvature formed in the disc during its manufacture. Because the disc in the present invention is acted upon along its entire surface, difficulty can be encountered in producing discs calibrated for relatively high pressures, for examples pressures on the order of 90 psi. If the disc is manufactured of material which is too thick, or if too much curvature is required, difficulty is encountered in obtaining calibration accuracy and the disc tends to be incapable of repeated cycling through a large number of cyclic operations. In order to overcome such difficulty, a structure as illustrated in FIG. 5 is used in which two discs are positioned immediately adjacent to each other, instead of a single disc as illustrated in the embodiment of FIG. 1.

Preferably, such discs are substantially identical, and are formed of the same material and provided with the same curvature. If, for example, the device is intended to operate in one direction at 90 psi, and in the other direction at 48 psi, two discs preferably each having calibration pressures of substantially 45 psi and 24 psi are used. In this embodiment, the disc **33*a* is positioned against the disc seat 32 and the second disc 33*b* is positioned between the disc 33*a* and the diaphragm 22. Here again, the discs operate the swtich through a bumper 36 in the same manner as described above in connection with the first embodiment. The structure of the overall device is essentially the same as in the first embodiment, except that the depth of the disc seat 32** in this embodiment is appropriately increased so that there is sufficient room to accommodate the additional thickness of the two discs.

If necessary, a thin film of material such as Teflon (not illustrated) can be positioned between the two discs to reduce any frictional contact therebetween to provide greater operating accuracy. Also in this embodiment the two discs can be selectively assembled for greater operating accuracy. For example, in the manufacture of discs, some discs have a calibration pressure on the lower side of acceptable tolerance and other discs operate on the high side of the tolerance, even though the discs are substantially identical within the range of possible manufacturing accuracy. In such instance, a disc on the low side of the tolerance is assembled with the disc on the high side of the tolerance to produce an assembly which operates essentially in the middle of the tolerance range. In practice, the assembled discs operate at a pressure which is substantially equal to the sum of the calibration pressures of the individual discs.

With this embodiment, the disc can be manufactured of thinner material or with lower curvatures so that the discs are capable of extended operation without failure, while providing a relatively high operating pressure.

Figure 6:
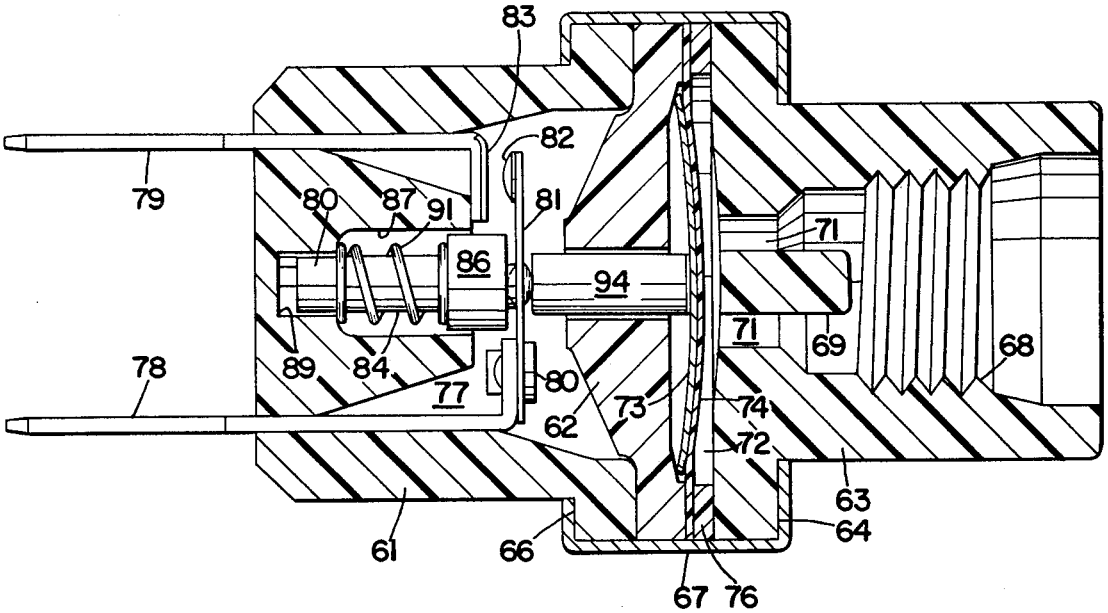
FIG. 6 is a longitudinal section of another embodiment providing a modified switch arrangement.
Figure 7:
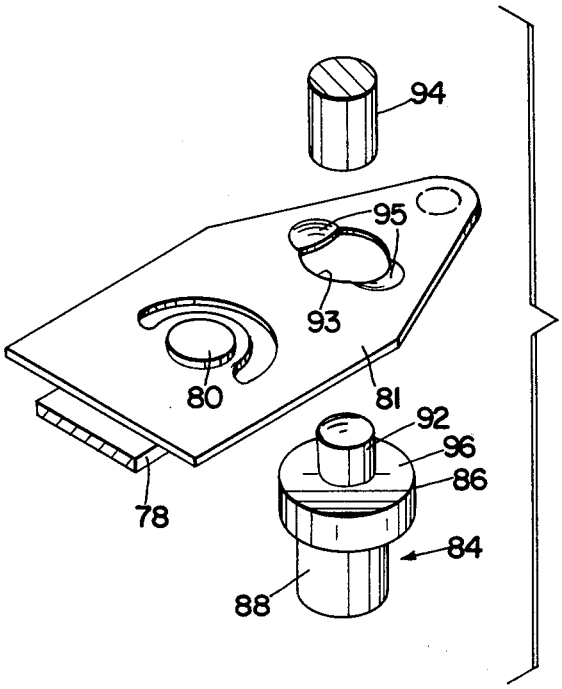
FIG. 7 is an exploded, perspective view of portions of the switch of the embodiment of FIG. 6.

FIGS. 6 and 7 illustrate an embodiment in which overpressure conditions cannot produce overstressing of the movable contact support arm. In this embodiment, the housing assembly includes a switch housing 61, a seat member 62, and a fitting portion 63, all of which are molded from plastic material, such as a phenolic resin. The fitting portion 63 is formed with a radial shoulder 64, which is opposed to a radial shoulder 66 formed on the switch housing 61, and a crimp ring 67 secures the parts together by embracing the opposed shoulders 64 and 66.

Here again, the fitting portion 63 is formed with a threaded opening 68, allowing the device to be threaded onto a Schraeder valve. In this embodiment, however, an integral projection 69 is molded into the fitting portion to open the Schraeder valve when the device is threaded into place. A plurality of axial passages 71 provide fluid communication through to the disc chamber 72 formed between the end face of the fitting portion 63 and the seat member 62. Such fitting portion may be machined from metal or be molded as illustrated.

Here again in this embodiment a snap disc 73 is held in an inclined seat formed in the seat member 62. The inclination of the seat insures that the disc is supported by its edge in both positions. In this particular embodiment, the seat member 62 is not formed with a forward face intended to fit the contour of the disc after the disc is snapped through, but instead is shaped to support the disc only substantially adjacent to its center after the disc is operated. A diaphragm 74 is again positioned against the disc in the same manner as the first embodiment, and a seal is provided by the gasket 76.

Positioned within a swtich chamber 77 defined by the switch housing 61 and the seat memeber 62 is a switch consisting of a pair of terminals 78 and 79. A movable contact arm 81 shaped as best illustrated in FIG. 7 is riveted at 80 to the inner end of the terminal 78. Mounted on the free end of the movable contact arm is a movable contact 82 which moves into and out of engagement with a fixed contact 83 provided on the inner end of the terminal 79. In this instance, however, the movable contact arm 81 is biased toward the closed position and is moved to its open position by an operator 84 in response to disc movement. The operator 84 is slidably mounted in the switch housing and is provided with a shoulder 86 guided within a first axial passage 87 and a reduced diameter guide projection 88 which is guided in a reduced diameter axial passage 89. A coil-type compression spring 91 engages the shoulder on the switch housing 61 at one end and the shoulder 86 at its other end and resiliently urges the operator 84 to the right, as viewed in FIG. 6.

The operator is provided with a reduced diameter projection 92, best illustrated in FIG. 7, which extends through an opening 93 in the movable contact arm 81 with clearance and engages the end of a cylindrical bumper 94. The bumper extends from the projection 92 to the disc 73 and transmits disc movement to the operator and, in turn, the movable contact arm 81. Such movable contact arm 81 is formed with a pair of projections 95 on opposite sides of the opening 93 which engage the face 96 of the shoulder 86 on the operator 84.

The force of the spring 91 is selected so that it is sufficient to overcome the spring action of the movable contact arm and to move the movable contact arm to the switch-open position illustrated in FIG. 6 when the disc 73 snaps through to its low pressure position.

The structure of this embodiment ensures that the movable contact support arm 81 is not overstressed under overpressure conditions, since the movement of the disc beyond the switch-closed position does not produce additional stress in the contact arm, but merely moves the operator away from the contact arm. Therefore, high stresses do not occur in the arm by bending it after the contacts are closed. In effect, the maximum stress that can be applied to the movable contact arm 81 is determined by the available force in the spring 91 and the position to which the disc 73 moves when the pressure drops. Actual tests have established that this structure virtually eliminates fatigue failures in the movable contact arm, even when the switch is operated through extremely large numbers of cycles. Switches of the type illustrated in the first embodiment often fail under life testing to 100,000 operating cycles. However, switch structures in accordance with the embodiment of FIGS. 6 and 7 regularly pass life testing of 200,000 or more cycles.

Although preferred embodiments of this invention are illustrated, it should be understood that various modifications and rearrangements of parts may be resorted to without departing from the scope of the invention disclosed and claimed herein.

What is claimed is:

1. A condition sensing switching device comprising a housing, a snap disc means in said housing movable with snap action between two positions of stability in response to predetermined operating conditions, a switch in said housing including a cantilever spring movable contact arm biased toward its switch-closed position, spring-biased operator means in said housing engaging said movable contact arm and operable to apply a spring force thereto in a direction toward a switch-open position moving it to its switch-open position in response to disc means movement to one of said positions of stability, said snap disc means being incapable of applying stress to said movable contact arm in a switch-closed direction while it is in its switch-closed position.

2. A condition sensing switching device as set forth in claim 1, wherein said movable contact arm provides an opening, and said operator means projects with clearance through said opening to said disc means, said operator means including a shoulder engageable with said movable contact arm on the side thereof remote from said disc means.

3. A condition sensing switching device as set forth in claim 2, wherein said operating means includes a spring-biased operator providing a projection extending through said opening and a bumper extending between said disc means and said projection.

4. A pressure switch comprising a housing assembly providing a cavity with a disc seat therein and a pressure port, shallow dished shaped snap disc means in said seat providing two positions of stability between which it moves in response to first and second predetermined pressures, said disc means dividing said cavity into a pressure chamber communicating with said pressure port and a second chamber isolated therefrom, pressure in said pressure chamber acting on said disc means and causing said disc means to snap between said positions of stability when the pressure in said pressure chamber reaches said predetermined pressures, a switch in said housing including a cantilever spring movable contact arm biased toward its switch-closed position, a spring-biased operator in said housing engaging said movable contact arm and operable to apply a spring force thereto to move it to its switch-open position in response to movement of said disc means to one of said positions of stability, said snap disc means being incapable of applying stress to said movable contact arm in a switch-closed direction while it is in its switch-closed position.

5. A pressure switch as set forth in claim 4, wherein said movable contact arm provides an opening, and said operator means projects through said opening to said disc means, said operator means including a shoulder engageable with said movable contact arm on the side thereof remote from said disc.

6. A pressure switch as set forth in claim 5, wherein said operator means includes a spring-biased operator providing a projection extending through said opening and a bumper extending between said disc and said projection.

7. A pressure switch as set forth in claim 4, wherein said disc means includes a plurality of substantially similar snap discs positioned in said seat, each disc individually being operable to snap at a calibration pressure, said switch operating at pressures substantially equal to the sum of the calibration pressures of said discs.

8. A pressure switch as set forth in claim 7, wherein there are two similar discs both having substantially the same calibration pressure.

9. A pressure switch as set forth in claim 8, wherein said disc means includes a flexible, nonmetallic diaphragm sealed within said housing assembly and engaging the side of said disc means remote from said seat, said diaphragm dividing said cavity into said pressure chamber and said second chamber.

10. A pressure switch as set forth in claim 4, wherein said disc means includes a flexible, nonmetallic diaphragm sealed within said housing assembly and engaging the side of said disc means remote from said disc, said diaphragm dividing said cavity into said pressure chamber and said second chamber.

* * * * *